United States Patent [19]

Rabinow

[11] Patent Number: 4,961,333

[45] **Date of Patent: * Oct. 9, 1990**

[54] KEY LOCK WITH TRANSFER TUMBLERS AND MASTER KEYING

[76] Inventor: Jacob Rabinow, 6920 Selkirk Drive, Bethesda, Md. 20817

[ * ] Notice: The portion of the term of this patent subsequent to Dec. 27, 2005 has been disclaimed.

[21] Appl. No.: 293,701

[22] Filed: Jan. 5, 1989

Related U.S. Application Data

[63] Continuation-in-part of Ser. No. 71,417, Jul. 9, 1987, Pat. No. 4,796,447.

[51] Int. Cl.[5] ..... E05B 29/02

[52] U.S. Cl. ..... 70/495; 70/419

[58] Field of Search ..... 70/376–378, 70/419, 421, 492, 494, 495

[56] References Cited

U.S. PATENT DOCUMENTS

| | | | |
|---|---|---|---|
| 2,023,847 | 12/1935 | Liss | 70/494 |
| 3,722,240 | 3/1973 | Spain | 70/494 |
| 4,356,713 | 11/1982 | Widen | 70/495 |
| 4,393,673 | 7/1983 | Widen | 70/495 |
| 4,637,234 | 1/1987 | Mielonen | 70/462 |
| 4,796,447 | 1/1989 | Rabinow | 70/495 |

*Primary Examiner*—Robert L. Wolfe

*Attorney, Agent, or Firm*—William D. Hall

[57] ABSTRACT

This specification describes an improved lock of the type described in my U.S. Pat. No. 4,796,447, granted Jan. 10, 1989. In locks of that type, a key is inserted into a key-cylinder and then the key sets a series of transfer tumblers that, in turn, set a series of lock opening elements. As the key-cylinder is rotated, the transfer tumblers are moved out of contact with the elements. Only at this time can the lock be opened, provided that the elements had been set correctly. The improvement in this specification permits the lock to be opened by more than one key. In other words, this lock permits "master-keying".

19 Claims, 1 Drawing Sheet

KEY LOCK WITH TRANSFER TUMBLERS AND MASTER KEYING

RELATED APPLICATION

This application is a continuation-in-part of my prior copending application Ser. No. 07/071,417, filed July 9, 1987, entitled Lock With Key Isolation Using Transfer Tumblers, now U.S. Pat. No. 4,796,447.

BACKGROUND OF THE INVENTION

In my U.S. Pat. Nos. 4,599,877, and 4,796,447, I describe a philosophy of locks that appears to be completely pick-proof. This is achieved by using the key to set a series of lock-controlling elements, then isolating the key and its key slot from the elements, and only then opening the lock if the elements have been set correctly.

In my U.S. Pat. No. 4,599,877 the key sets the elements directly, while in my U.S. Pat. No. 4,796,447, the key sets a series of intermediate elements, called transfer tumblers. These transfer tumblers set the lock-controlling elements and then the key, the key slot, and the transfer tumblers are isolated from the lock-controlling elements. Only after this has happened, can the lock be opened, if the elements have been set correctly.

In the locks described in my prior patents cited, I do not show how a master key can be employed. As is well known in the art, there is often a need to have a master key that can open a number of locks, each otherwise having its own proper key.

Sometimes a Grand-Master key is needed by which a large number of locks can be opened, where each sub-group of locks must be opened by a master key complementary to that sub-group, and where each lock can be opened by its own key. My present invention provides the master-keying described in this paragraph.

I accomplish the above improvements by using a sidebar to co-operate with notches or holes in the lock controlling elements, as will be described in detail below.

DETAILED DESCRIPTION OF THE DRAWINGS

Figure 1:
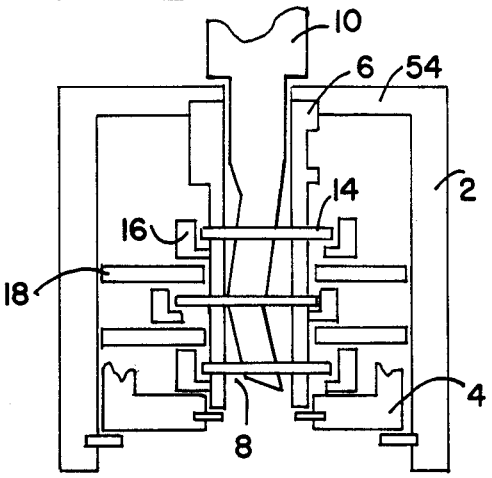
FIG. 1 shows a simplified vertical section of my lock.
Figure 2:
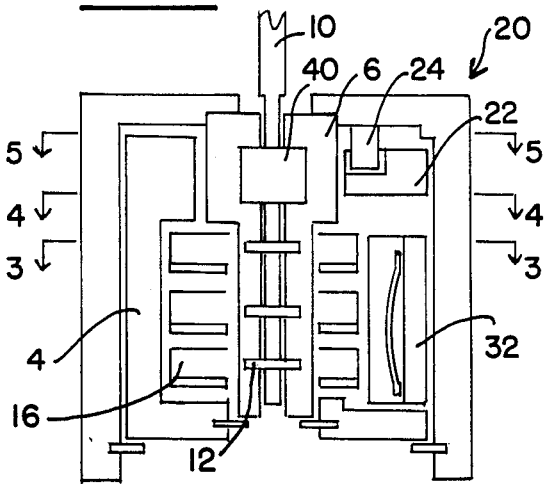
FIG. 2 shows another vertical section of the lock, taken at 90° from the position of FIG. 1.

FIGS. 1 and 2 show schematic diagrams of the principal parts of my lock. The lock consists of three principal parts. The outside case 2 may be a cylinder. Directly inside of this cylinder 2 there is located a narrow cylinder 4 that can be seen more clearly in FIGS. 2, 3 and 4. To open or close this lock, it is this cylinder 4 that must be turned relative to the outside case 2.

Figure 3:
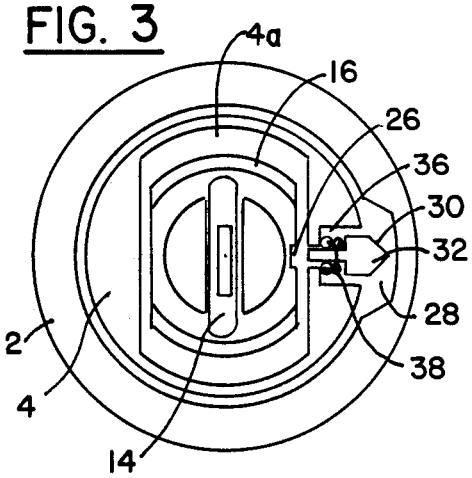
FIG. 3 shows a section of the lock of FIG. 2 taken approximately along line 3—3.

In the center of this lock there is located a third cylinder 6 that has a longitudinal passage 8 for the double bitted key 10. At right angles to this passage 8 there are three (in this example) cross slots 12 just large enough to permit the transfer tumblers 14 to slide freely through them. FIG. 3 shows one of these tumblers 14. In this embodiment the tumblers 14 are all identical and contain no information.

The reason for the key 10 being cut along both edges is that it should be able to position the tumblers 14 without the use of springs. A more detailed example of the action of such a key using transfer tumblers is described in my co-pending application No. 07/152,405 filed Feb. 4, 1988, and now U.S. Pat. No. 4,825,672 entitled "Key For Flat Tumblers".

In the plane of each tumbler 14 and located inside the cylinder 4 there is located a sliding lock-controlling element 16, see FIGS. 1, 2, 9 and 10.

There are spacers 18 between the elements 16 as shown in FIG. 1.

When the key 10 is inserted into the key slot 8 in the key-cylinder 6, the tumblers 14 will be shifted in their slots 12. This motion will result in the positions shown in FIGS. 1 and 3. This would permit the cylinder 4 to turn except for one more provision.

Figure 5:
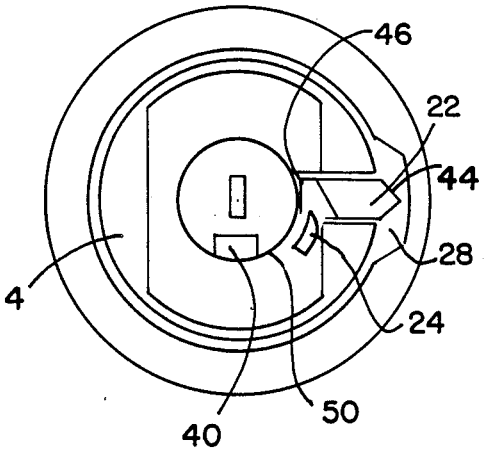
FIG. 5 shows a section of the lock of FIG. 2 taken approximately along line 5—5 of FIG. 2.

At the top of cylinder 4 there is a cam operated interlock generally labeled 20 in FIG. 2. Its operation will be described below. Its function is similar to that of interlock 18 described in my U.S. Pat. No. 4,599,877 and in my U.S. Pat. No. 4,796,447. Its operation, however, differs from that of the interlock of my prior inventions in that the return motion of the interlock pin 22 to the positions shown in FIGS. 2 and 5 is not caused by the action of a spring, but is produced by a more positive action of a restoring cam 24 shown in FIGS. 2, 5, and 6. Before discussing in detail the action of this interlock 22, the design and functions of the lock controlling elements 16 must be explained.

Figure 9:
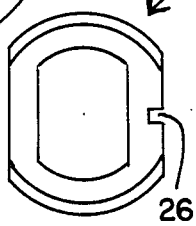
FIG. 9 shows a top view of a lock controlling element having one notch.
Figure 10:
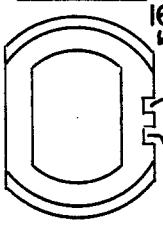
FIG. 10 shows a top view of a lock controlling element having two notches.
Figure 11:
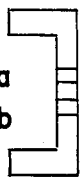
FIG. 11 shows a side view of the element of FIG. 10.
Figure 7:
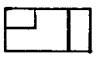
FIG. 7 shows a side view of the interlock pin.
Figure 8:
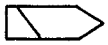
FIG. 8 shows a top view of the same pin.

FIG. 3 shows a section of the lock taken along line 3—3 of FIG. 2. It can be seen that the key 10 sets the tumblers 14. In FIG. 3 it can be seen that each tumbler 14, in turn, sets its complementary lock-controlling element 16 into its position. This control element 16 is shown in FIGS. 9 and 10 and in side view in FIG. 11. It will be noted that there are one or more notches 26 cut into one edge of the element 16.

Consider now FIGS. 2, 3, 4 and 5. There is a notch 28 formed longitudinally in case 2 (vertically in FIG. 2). This notch 28 acts as a cam on the outside edge 30 of the side bar 32 (FIG. 3). This side bar 32 is fitted into a vertical slot 36 in the cylinder 4. A spring 38 acts on this side bar 32 to push it outward so as to press its edge 30 into the notch 28 in the outside case 2.

For the cylinder 4 to rotate, the side bar 32 must move to the left as seen in FIGS. 2 and 3. This can only happen if the lock controlling element 16 has been so positioned that its notch 26 is aligned with the side bar 32, as seen in FIG. 3.

It will be understood that in the lock shown in FIGS. 1 and 2 all three elements 16 must be so positioned that all of their notches must be aligned with the side-bar 32.

Figure 4:
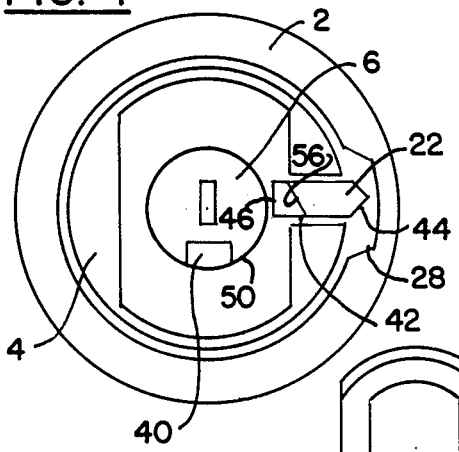
FIG. 4 shows a section of the lock of FIG. 2 taken approximately along line 4—4 of FIG. 2.

It is now appropriate to return to the description of the interlock generally labeled in FIG. 2. The notch 28 in the case 2 serves a double purpose (in FIG. 5). It not only acts as a cam to operate the side bar 32 but also to move the interlock pin 22. In FIG. 4 I show a section of FIG. 2 taken roughly along line 4—4 of FIG. 2. The key cylinder 6 has a depression 40 located as shown in FIGS. 2, 4, 5 and 6. An interlock pin 22 is positioned in a well fitting passage 42 in the cylinder 4. The outside end 44 of this pin 22 is normally located in the notch 28 in the case 2. When the lock is closed, or locked, as shown in FIGS. 2 and 4 this pin 22 can not move out of the notch 28 because its other end 46 abutts the side 50 of the keycylinder 6 (FIG. 5). However, if a key 10 is inserted into the slot 8 of the key-cylinder 6 and turned 90° counter clockwise (as in FIG. 6) the depression, 40, in this cylinder 6 is aligned with the end 46 of the pin 22, the pin 22 can now be cammed out of the notch 28, and enter the depression 40.

The cylinder 4 now can turn, provided that all of the lock-controlling elements 16 have been correctly set so that their notches 26 have all been correctly lined up with the fence 32.

If an incorrect key, or a pick, had been used to move the transfer tumblers 14 and thus to set the elements 16 so that one or more of their notches 26 has not been aligned with the fence 32, the fence could not be cammed out of notch 28 and the lock could not be opened.

The main feature that makes this lock impossible, or at least extremely difficult, to pick, is that before there is any possibility of determining whether the elements 16 have been correctly set, the key cylinder 6, must be turned approximately 90°, as described. In this position (FIG. 6) the transfer tumblers 14 are no longer in contact with the lock controlling elements 16. Therefore, moving them (the tumblers) by a lock-picking tool can not move the elements 16 that determine whether the lock can be opened or not.

Figure 6:
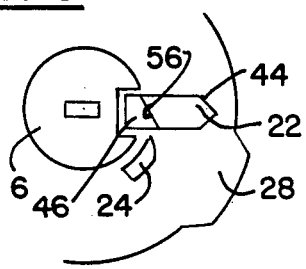
FIG. 6 shows a partial section of the lock of FIG. 2 taken along line 5—5 of FIG. 2 after the key cylinder has been turned approximately 90° counter-clockwise as viewed in FIG. 5.

When it is desired to close the lock, the key 10 is turned clockwise as viewed in FIGS. 5 and 6. Because the interlock pin 22 has coupled the key cylinder 6 and the middle cylinder 4 together, the middle cylinder 4 will also turn clockwise until the pin 22 reaches the notch 28. At this point the key cylinder 6 is disconnected from the cylinder 4 because of the action of the cam 24 which is rigidly attached to the top plate 54 of the lock. FIGS. 5 and 6 show the location of this cam 24. This cam 24 acts on the angular surface 56 of the interlock pin 22. In this detail of the interlock mechanism this invention differs for the locks described in U.S. Pat. Nos. 4,599,877 and 4,796,447.

If it is desired to operate the lock described in this application by more than one key, it is only necessary to have more than one notch 26 in some or all of the lock controlling elements 16 as seen in FIG. 10. The practice of using more than one key to open one lock is known in the art as "Master Keying" and its purposes and advantages need not be detailed here. It is, even possible to provide more than two notches per element 16.

In an earlier part of this specification I assumed that all of the tumblers 14 were identical and contained no information. This made the explanation of the design of this lock much easier. However, as was described in my U.S. Pat. No. 4,796,447, the transfer tumblers need not be all alike. They may be variable in the location of the key slot through them or in their length. All that is required in that case is that the lock controlling element (labeled 16 in this application) must be correctly matched to the tumblers that move them. This may simply be the correct positioning of the notch 26 in each element 16, or a modification of the exact size of each element.

While I disclose the use of a double bitted key in the foregoing description, it is obvious that a single-bitted key can be used, as shown in my U.S. Pat. No. 4,796,447. (See FIGS. 14, 15 and 16 of that patent). Here the transfer tumblers 43 are pressed against the key by springs 48. This is well understood in the art. The motion of such tumblers is no different from those moved by a double-bitted key. The operation of the rest of the lock is identical.

The above description leaves out customary details like fasteners, rotation stops, key guidance details, grooves along the key to control its insertion, etc.

In the form of the invention shown, there is only one pin 22 for the entire lock.

The cam 24 is stationary and when the lock is rotated to its locked position, for example, when in FIG. 5 the key cylinder 10 rotates clockwise, the stationary cam 24 acting on surface 56, drives pin 22 into notch 28.

OPERATION

Assuming that the lock has control elements 16 with only one notch 26 as shown in FIG. 9, the insertion of the correct key 10 will set tumblers 14 which in turn will set the control elements 16 (within the opening 4*a* of middle cylinder 4) so that the notch 26, in each control element 16, is aligned with the side bar 32. When the key 10 is rotated the depression 40 will align itself with pin 22. As the key 10 is rotated further the middle cylinder 4 is rotated thus moving the pin 22 and the side bar 32 into contact with the tapered wall of notch 28. The pin 22 thus enters the depression 40, and a slight further rotation will cause the side bar 32 to enter the notches 26. The middle cylinder 4 will, therefore, rotate relative to the cylinder 2 as the key is turned further. The lock will now open.

Next, assume that we want to equip a three story building with door locks and keep the following three requirements:

1. Each door of the building must have a unique key.
2. Each floor must have a master key that can open any door on that floor.
3. All doors of the entire building can be opened by a grand-master key.

Assume that each lock of this example has six locking elements 16, and each can have two notches 26 (see FIG. 10) in any desired location. I will call each locking element of one lock by a letter, A to F; and the location of each of the two notches 26 of one element 16 by a numeral 1 to 9, depending on the location of the notch. This means that each bit of the key can have nine different "heights" or cuts corresponding to each numeral of a notch on a locking element.

The following table represents a possible design of locks and keys that can be used to secure the building under the above assumptions.

TABLE

| | Elements: | | | | | | |
|---|---|---|---|---|---|---|---|
| | A | B | C | D | E | F | |
| 1st Floor | 3 | 5 | 7 | 2 | 4 | 6 | 1st door |

TABLE-continued

| | Elements: | | | | | | | |
|---|---|---|---|---|---|---|---|---|
| | A | B | C | D | E | F | | |
| | 3 | 5 | 7 | 6 | 2 | 9 | 2nd door | 1st notch |
| | 3 | 5 | 7 | etc. | | | etc. | |
| 1st Floor | | | | 1 | 3 | 5 | 1st door | 2nd notch in position |
| | | | | 1 | 3 | 5 | 2nd door | DEF for all keys on |
| | | | | 1 | 3 | 5 | etc. | 1st Floor |
| 1st Floor | 3 | 5 | 7 | 1 | 3 | 5 | Master Key | |
| 2nd Floor | 1 | 3 | 9 | 1 | 2 | 4 | 1st door | |
| | 1 | 3 | 9 | 6 | 2 | 7 | 2nd door | 1st notch |
| | 1 | 3 | 9 | etc. | | | | |
| 2nd Floor | | | | 1 | 3 | 5 | 1st door | 2nd notch in position |
| | | | | 1 | 3 | 5 | 2nd door | DEF for all keys on |
| | | | | 1 | 3 | 5 | etc. | 2nd Floor |
| 2nd Floor | 1 | 3 | 9 | 1 | 3 | 5 | Master Key | |
| 3rd Floor | 2 | 8 | 9 | 7 | 5 | 1 | 1st door | |
| | 2 | 8 | 9 | 3 | 5 | 3 | 2nd door | 1st notch |
| | 2 | 8 | 9 | etc. | | | | |
| | | | | 1 | 3 | 5 | 1st door | 2nd notch in positions |
| | | | | 1 | 3 | 5 | 2nd door | DEF for all keys on |
| | | | | 1 | 3 | 5 | etc. | 3rd Floor |
| 3rd Floor | 2 | 8 | 9 | 1 | 3 | 5 | Master Key | |
| | 9 | 8 | 2 | | | | 2nd notch for positions A B C for all keys | |
| | 9 | 8 | 2 | 1 | 3 | 5 | Grand-Master key for all floors | |

If the six bits A, B, C, D, E and F are cut so that their heights are 9 8 2 1 3 5 respectively the six control elements 16 will each present its notch **26*b* (FIG. 10) to the side bar 32**. This provides the grand master key for all doors on all floors.

Referring now to the keys for the first floor of the building, all of the keys including the master key for that floor will have the first three bits A, B, C of the keys the same, for example 357. The last three bits D, E and F will all, however, be different, with the master key having bits D, E and F at 135 (the same as the other master keys including the grand master key). Thus the three control elements 16 for bits A, B and C will use the notch **26*a* (FIG. 10). Except for the first floor master key and the grand master key, bits D, E and F on the first floor keys will all use the notch 26*a***.

Similarly, all of the keys for the second and third floors use the notch **26*a* (FIG. 10), but not notch 26*b***, except for the master keys and the grand master key.

The table explains the matter in detail.

It is noted that I used only two notches per locking element 16 to achieve this result. It is possible to use more than two notches if desired.

It should be noted that using master keying reduces the security of a lock because of the possibility of some nonscheduled key bitting that can open such a lock in addition to the single key and the master key. With two possibilities for each element and six elements one can have $2\times2\times2\times2\times2\times2$ possible keys, or a total of 64 keys that can open a particular lock.

It should be understood that the illustrations of FIGS. 9 and 10 are not to scale. The notches in an actual locking element are much narrower, relatively to the dimensions of the element 16. This permits the designer of the lock to have several (9 in the example earlier) distinct and separate notches.

For example, assume that the space on the side of an element 16 is 0.250 in. ($\frac{1}{4}$ in.). This means that the key bitting for this lock can have "height" for cuts over a height of 0.250 in. If the notches are cut to be 0.020 in. wide each, they could occupy $9\times0.020$ or 0.180 in. total height of the element. This leaves approximately 0.250 −0.180 in., or 0.070 in. for spaces between them or approximately 0.008 in. In such a design there would never be a possibility that two adjacent notches could touch. It could happen, depending, on the design of a master key, that in one or more elements a common notch may be used for a unique key and a master key. This does not cause any difficulty. It simply means that, for example, a key with bitting 135262 and a master key bitting 738751 would use a common notch in the second element. It would have only one notch, and it would be in position 3.

Assume now, as a second possibility that the notches are designed wider so there is no space between them. Thus if two notches were numbered 3 and 4, the result would be a very wide notch and a fence (side bar 32) could enter this notch in ways that are not desirable. The designer of such a lock would then program the bitting of the key, and the notching of the elements, so as not to permit two adjacent position of two notches. In a lock-and-key where no master keying is required, this problem does not arise.

It should be further understood that in the table illustration shown earlier, the use of the notch **26*a* or notch 26*b*** makes the explanation clearer. In practice, each of the two notches in a single element is independent of the other notch and their positions can make them approach each other, or space them further apart, or in fact make their positions cross each other. Thus if one notch is defined by numeral 4 and the second by numeral 6, the second can be considered to be above the first. If the second is located as defined by numeral 2, it would be located below the first.

If the two notches are defined by the same numeral, as 3 and 3, then they are in fact, a single notch.

I claim to have invented:

1. A lock which may be opened by at least two different keys, each having a plurality of bits, comprising:

first and second members which when moved relative to each other at least a given distance enable the lock to open, a third member having a passageway for receiving any one of said keys, a plurality of first elements set by the key, which is in said passageway, to positions determined by the bits of such key, a plurality of second elements respectively set by said first elements to positions determined by the bits of the key that is in said passageway; said second elements being set into different relative positions by the different keys, respectively, and means normally preventing relative movement of said first and second members but which does not prevent such movement when said second elements are set in any one of said relative positions.

2. A lock as defined in claim 1 including means for normally preventing said members from having said relative movement but which does not prevent such movement if the key sets said second elements to one of said relative positions and has been rotated at least a given angular amount.

3. A lock as defined in claim 2 including means for moving said first elements when the key rotates so that the first and second elements are no longer in an operative relation to each other, said second elements remaining in the positions in which they were set by reason of the key positioning the first elements which in turn positioned the second elements,

4. A lock as defined in claim 1 in which each of said second elements has a notch which moves with the element when the second element is moved by a first element, said last-named means comprising a side bar; said side bar (a) in one position prevents relative motion of said first and second members, and (b) moves, when the lock is opened by a correct key, into a second position wherein part of it is in said notches.

5. A lock as defined in claim 4 wherein said notches are in a predetermined position when said means is in said second position.

6. A lock as defined in claim 1 in which each of said second elements has two notches which move when their complementary second element is moved, said means comprising a side bar; said side bar (a) in one position prevents relative motion of said first and second members, and (b) moves, when the lock is opened by a correct key, into a second position wherein part of it is in one notch in each of said elements.

7. A lock as defined in claim 6, in which said two notches are spaced further apart in one of said second elements than in another one of said second elements.

8. A lock as defined in claim 6, wherein for at least one of said second elements the side bar enters one of said notches on such second element when one correct key is used to open the lock and enters the other one of said notches on such second element when another correct key is used to open the lock.

9. A lock as defined in claim 1 in which at least one of said elements has a sidewall and first and second notches in said sidewall, said means entering one of said notches of said one second element, so that it does not prevent movement of said first and second members when a first correct key is in said passageway, said means entering the other one of said notches of said one second element, so that it does not prevent movement of said first and second members when a second correct key is in said passageway.

10. A lock which may be opened with a key having a plurality of bits, comprising:

first and second members which when moved relative to each other at least a given distance enable the lock to open, a third member having a passageway for receiving the key, a plurality of first elements set by the key to positions determined by the bits of the key, a plurality of second elements movable back and forth in a given path of travel and respectively set by said first elements to positions determined by the bits of the key, and means movable transverse to said given path of travel for normally preventing relative movement of said members but does not prevent such movement if said elements are in predetermined positions.

11. A lock as defined in claim 10 including means for normally preventing said members from having said relative motion but which does not prevent such motion if said key has been rotated at least a given angular amount.

12. A lock as defined in claim 11 including means for moving said first elements when the key rotates so that the first and second elements are no longer in an operative relation to each other, said second elements remaining in the positions in which they were set by reason of the key positioning the first elements which in turn positioned the second elements.

13. In a lock that may be opened with a correct key, said key having bits:

an outer cylindrical member having an inner wall that has an inside diameter, a second member within said outer cylindrical member, said lock being locked when said members are in given relative positions, a rotatable key-receiving device having a passageway for receiving said correct key, a plurality of first elements which are in predetermined positions when said correct key is in said passageway, a plurality of second elements set by said first elements to given positions when said correct key in in said passageway, said second elements being sufficiently small that they remain within said inside diameter whenever they are set by any key irrespective of whether the key is a correct one, and means for normally maintaining said members in a relative position in which the lock is locked while allowing said members to move to unlock the lock when said second members are in said given positions.

14. A lock as defined in claim 13, in which said key-receiving means includes means for rotating said first elements out of their operative relations with said second elements when a correct key is placed in said passageway and then rotated.

15. In a lock as defined in claim 13:

each of said second elements having a sidewall, said means, cooperating with said sidewalls to sense when said elements are in positions wherein the lock should be permitted to open, for allowing said members to have the relative movement required to open the lock when the key is a correct one.

16. In a lock as defined in claim 13:

said second elements being settable by two different keys to different relative relationships to each other, said means being responsive to said relative relationships for allowing the lock to open when either of such relative relationships exists.

17. In a lock as defined in claim 16, each of said second elements having a sidewall, first and second notches in said sidewalls, said means comprising one side bar for all of the second elements, the side bar for the second elements entering a notch in a side wall of such second elements when the second elements are set to a correct lock-opening position, said means allowing the lock to open when the said sidebar has entered a notch in the side wall of each second element.

18. In a lock as defined in claim 13, said second elements remaining in the positions that they were set by a key during the entire remainder of the effort to open the lock.

19. In a lock as defined in claim 18:

said first elements having an operative relation to said second elements while the key sets said first elements so that the first elements in turn sets the second elements, said key-receiving device including means for moving said first elements to a position where they are no longer in an operative relation to said second elements when the key is rotated.

* * * * *